US006513946B2

(12) United States Patent
Hillinger et al.

(10) Patent No.: US 6,513,946 B2
(45) Date of Patent: Feb. 4, 2003

(54) COMPACT DRIVER

(75) Inventors: George Hillinger, Los Angeles, CA (US); Hector Ray Hernandez, Whittier, CA (US); Jaime W. Nash, Rancho Santa Margarita, CA (US)

(73) Assignee: Alltrade Inc., Long Beach, CA (US)

( * ) Notice: Subject to any disclaimer, the term of this patent is extended or adjusted under 35 U.S.C. 154(b) by 0 days.

(21) Appl. No.: 10/086,669

(22) Filed: Feb. 28, 2002

(65) Prior Publication Data

US 2002/0093816 A1 Jul. 18, 2002

Related U.S. Application Data

(63) Continuation-in-part of application No. 09/523,885, filed on Mar. 13, 2000, now abandoned.

(51) Int. Cl.[7] ..... B25B 23/18

(52) U.S. Cl. ..... 362/119; 362/120; 81/177.2

(58) Field of Search ..... 362/119, 120, 362/253; 81/467, 436, 177.6, 177.8, 177.2, 177.1, 489

(56) References Cited

U.S. PATENT DOCUMENTS

| | | | | | |
|---|---|---|---|---|---|
| 4,581,958 | A | * | 4/1986 | Shull | 81/177.2 |
| 5,899,554 | A | * | 5/1999 | Hsu | 362/119 |
| 5,911,798 | A | * | 6/1999 | Arnold | 81/177.2 |
| 6,089,729 | A | * | 7/2000 | Chang | 362/120 |
| 6,106,133 | A | * | 8/2000 | Lee | 362/119 |
| 6,116,746 | A | * | 9/2000 | Hsu | 362/119 |
| 6,126,295 | A | * | 10/2000 | Hillinger | 362/119 |

* cited by examiner

*Primary Examiner*—Thomas M. Sember
(74) *Attorney, Agent, or Firm*—Robert R. Thornton

(57) ABSTRACT

A compact ratcheting driver has a handle portion and a an extendible ratcheting head portion. The head portion has a pair of parallel guide rails which are coplanar with and extend into the handle to engage a pair of complementary guide shoulders formed within the handle. The head portion includes ratcheting means connected to a driver element for engaging and driving an element to be driven and detent means for selectively locking the head portion in either an extended disposition or a retracted disposition. In one embodiment, the handle portion includes a fixed drive socket. In a second embodiment, the handle includes selectively manually actuated lighting means to illuminate a work area in which the ratcheting driver element is to engage a driven element.

11 Claims, 12 Drawing Sheets

COMPACT DRIVER

CROSS REFERENCE TO RELATED APPLICATION

This application is a continuation-in-part of U.S. patent application Ser. No. 09/523,885, filed Mar. 13, 2000 now abandoned.

BACKGROUND OF THE INVENTION

1. Field of the Invention

This invention relates to a compact tool for manually applying torque to a fastener, and more particularly to such a tool with a ratcheting driver and which may include a fixed driver.

2. Description of the Prior Art

Compact tools for manually applying torque to a fastener by means of a ratcheting drive and driven element, which may be a socket or a screwdriver tip, for example, are known in the art. Typically, such tools are designed to be hand-held and sufficiently small such that the user may carry the tool in a pants or shirt pocket. In some such devices, the tool handle, if any, is too short to provide sufficient mechanical advantage to permit the user to apply sufficient torque to the fastener to accomplish the required task. U.S. Pat. No. 5,542,322, issued Aug. 6, 1996 to R. L. Knox et al., attempted to solve this problem by providing a ratcheting head which is pivotally attached to a handle, so as to be pivotal between a folded position, in which the ratcheting head is substantially surrounded by the handle, and an operating position, in which the ratcheting head extends outwardly from the handle in longitudinal alignment therewith. However, because of the use of a pivotal attachment between the ratcheting head and the handle, such devices are still limited in the amount of torque which may be applied to the fastener without breaking the pivotal connection. Also described, but not shown, is an "alternative embodiment" utilizing tongues projecting from the ratcheting head which are received in grooves formed in the handle.

SUMMARY OF THE INVENTION

According to the present invention, a compact driver has a handle connected at a first end to a ratcheting head portion by a pair of coplanar guide rails extend into the handle to engage a pair of complementary guide shoulders formed in the interior of the handle and the head portion having ratcheting means connected to a depending driver element for engaging and driving an element to be driven. In one embodiment, the handle includes a selectively manually actuated lighting means which is operable, when actuated, to illuminate a work area in which the driver element is to engage the driven element. In a second, presently preferred, embodiment, the handle includes a drive socket at a second end, opposite the first end, for use with removable tools, such as screwdriver bits.

DETAILED DESCRIPTION OF THE DRAWINGS

Figure 1:
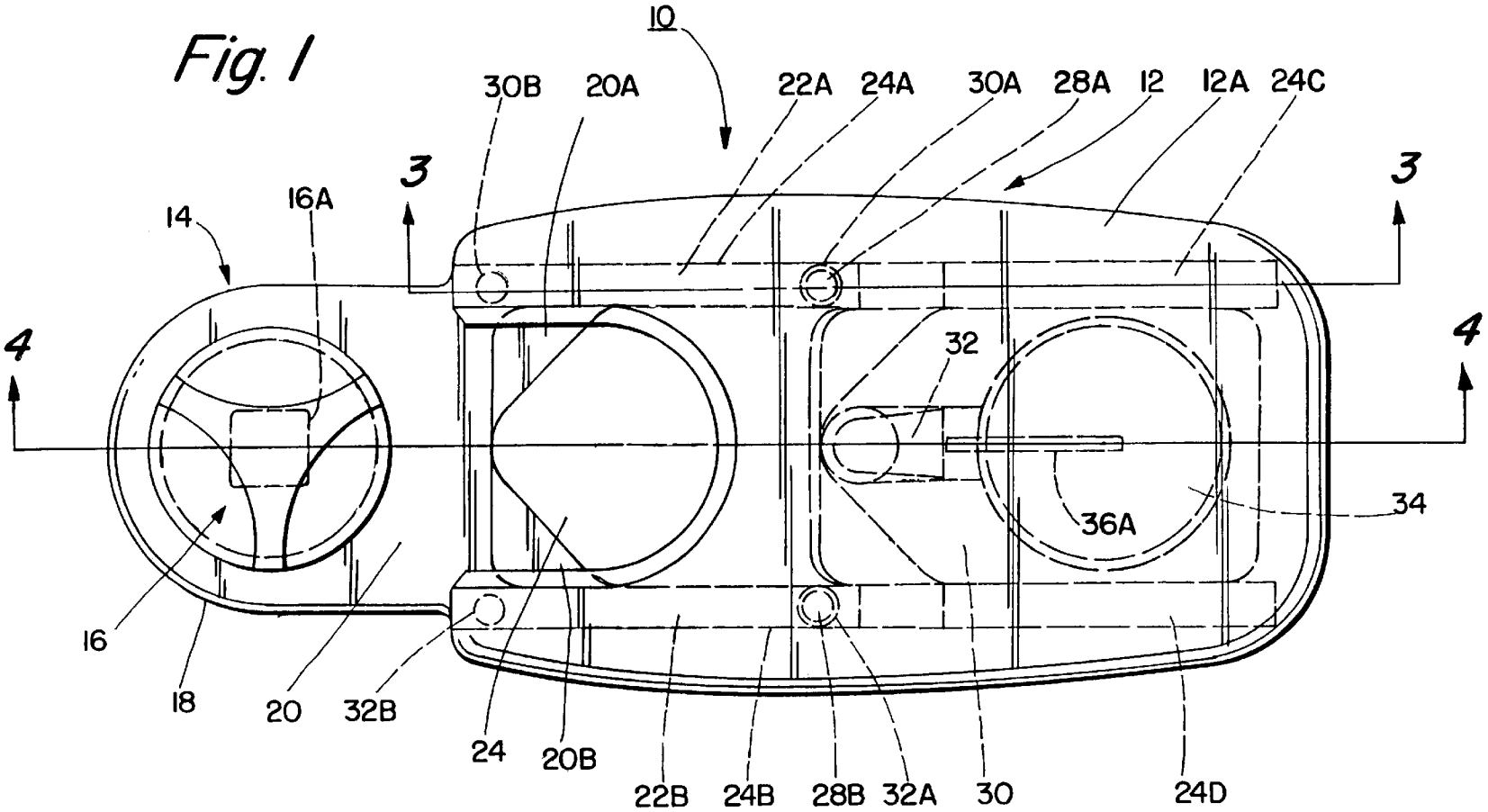
FIG. 1 is a top plan view of a compact ratcheting driver according to the present invention with a selectively manually operable lighting means and with its ratcheting head shown in its extended position.
Figure 2:
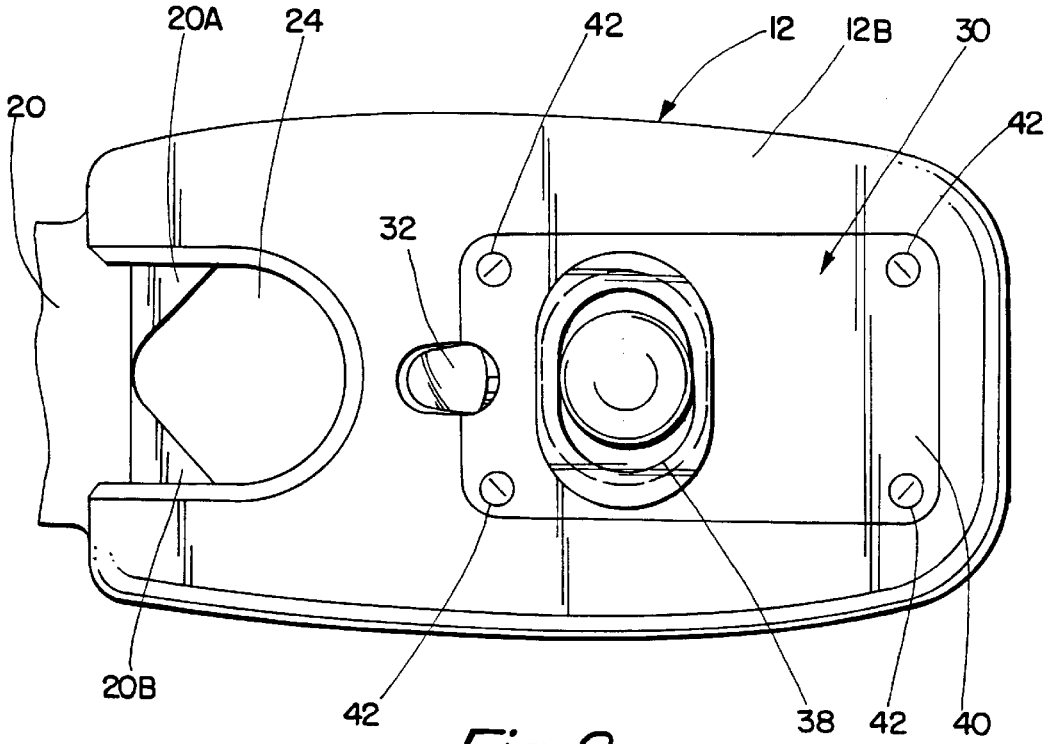
FIG. 2 is a partial bottom plan view of the driver of FIG. 1.
Figure 3:
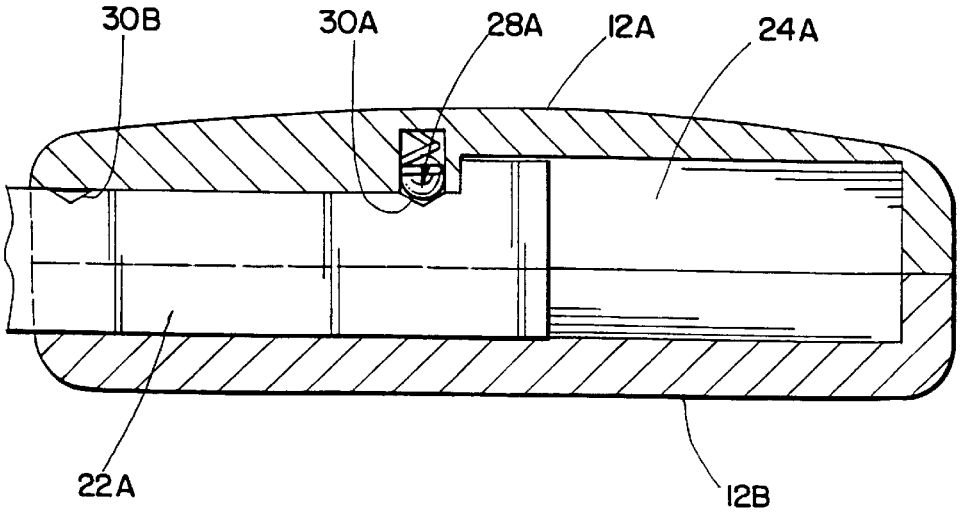
FIG. 3 is a right side elevational view, in section, of the driver of FIG. 1, taken along line 3—3 of FIG. 1.

Referring first to FIGS. 1–6, a compact ratcheting driver 10 has a handle portion 12 and an extensible ratcheting drive portion 14. The drive portion 14 had a ratchet drive mechanism 16, which is conventional in design, has a driver element 16A, of any conventional configuration, and is mounted in a drive head 18. The drive head 18 has a central web 20 and an pair of guide rails 22A, 22B (shown in dotted lines in FIG. 1), disposed on opposite sides of the web 20, so that the web 20 is intermediate thereof. Reinforcing flanges 20A, 20B extend from the web 20 to the guide rails 22A, 22B, respectively to maintain the rails 22A, 22B in a parallel disposition to one another and in a coplanar disposition with the handle 12. The guide rails extend into a hollow central portion 24 formed in the handle 12 so as engage a pair of complementary guide shoulders 24A, 24B (see FIG. 4).

Figure 5:
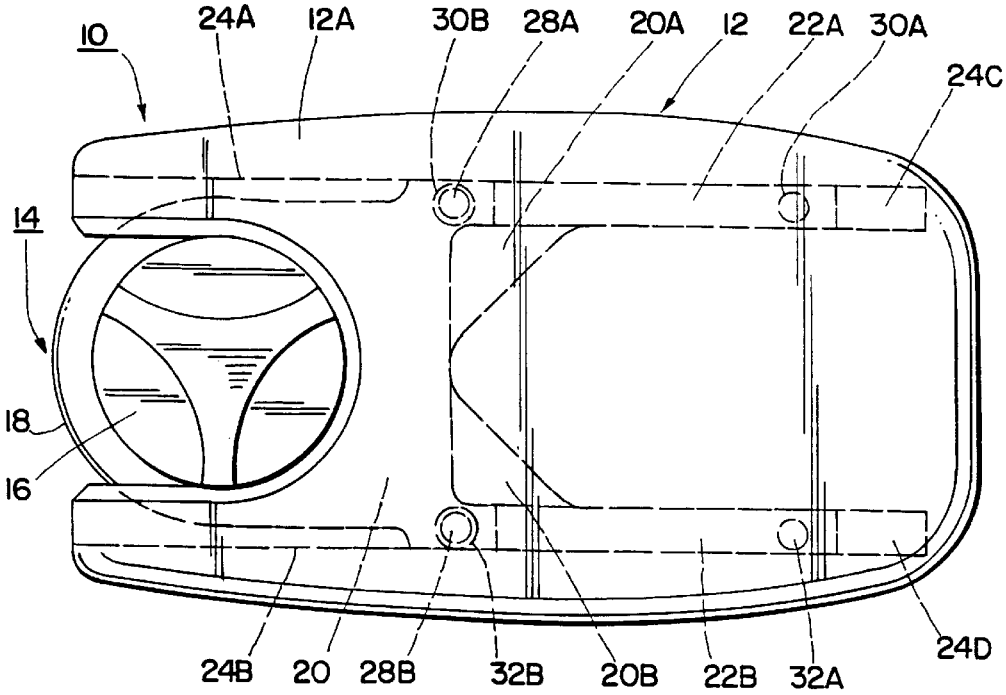
FIG. 5 is a top plan view of the compact ratcheting driver shown in FIG. 1 but with its ratcheting head in its retracted position.
Figure 6:
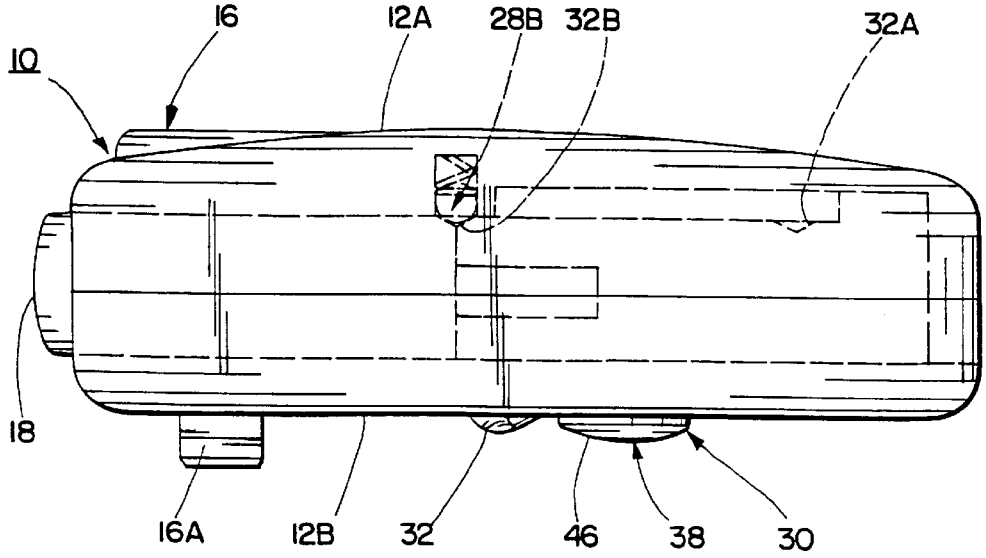
FIG. 6 is a right side elevational view of the ratcheting driver of FIG. 1 but in its retracted disposition as shown in FIG. 5.

The handle portion 12 has an upper element 12A and a lower element 12B (see FIGS. 3 and 4), which are attached together by any conventional means, such as a nut and bolt combination (not shown). A pair of spring loaded balls 28A, 28B are disposed in the handle upper element 12A and engage the rails 22A, 22B, respectively. Each of the rails 22A, 22B has a pair of recesses 22C, 22D and 22E, 22F, respectively, which are adapted to receive the spring loaded balls 28A, 28B, respectively to function as conventional spring loaded detent mechanisms, whose operation in stopping the extensible ratcheting drive mechanism 14 between its extended disposition shown in FIG. 1 and its retracted disposition shown in FIGS. 5 and 6 is obvious. As is best seen in FIG. 5, the shoulders 24A, 24B have slotted portions 24C, 24D, respectively. The guide rails 22A, 22B extend into the slotted portions 24C,24D, respectively while continuing to abut the shoulders 24A,24B, when the extensible ratcheting drive portion 14 is retracted from its extended disposition shown in FIG. 1 to its retracted disposition shown in FIGS. 5 and 6 by manually overcoming the aforementioned spring loaded detent mechanisms.

Figure 4:
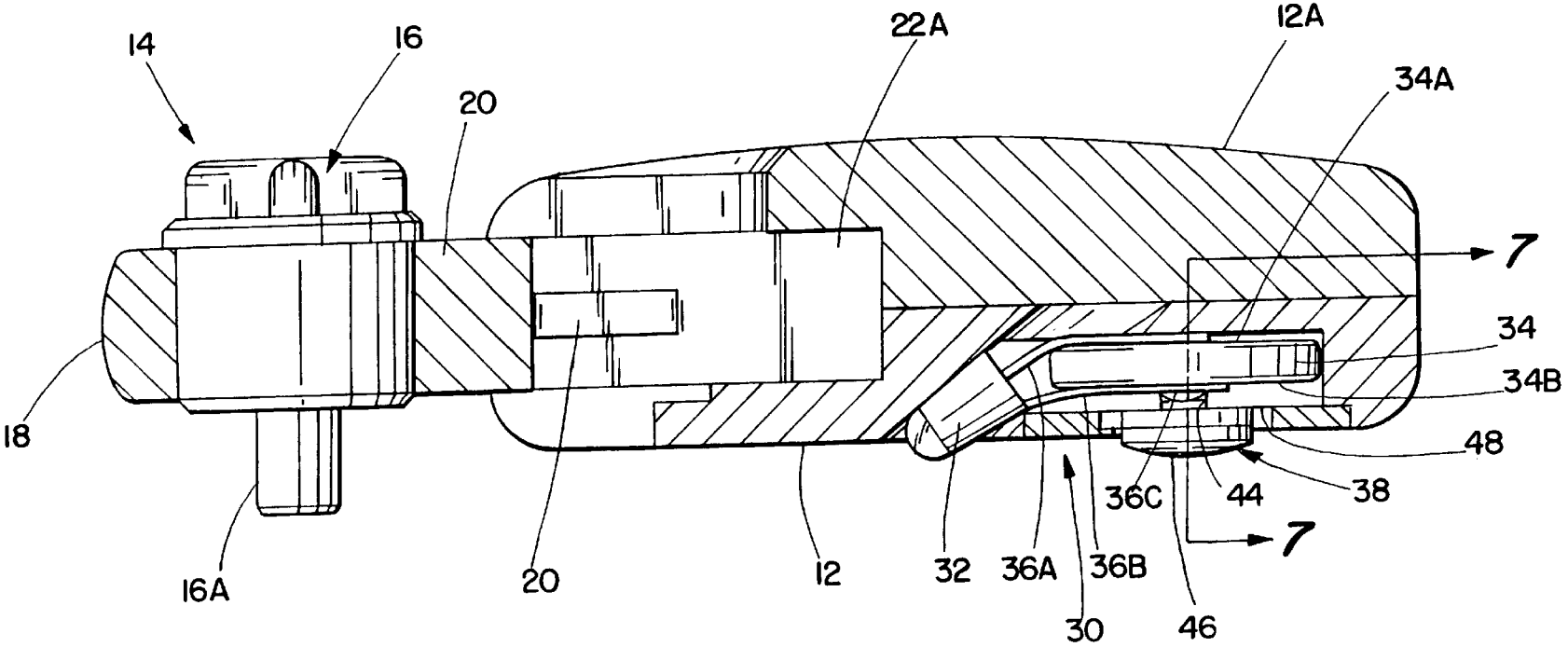
FIG. 4 is a right side elevational view, in section, of the driver of FIG. 1, taken along line 4—4 of FIG. 1.

The compact ratcheting driver 10 has selectively actuated lighting means 30 contained in the handle portion lower element 12B, as is seen in FIGS. 1, 2, 4, and 6–9. As is best seen in FIG. 4, the lighting means 30 has a light bulb 32 disposed at an angle in a passageway 12C formed in the lower element 12B. The angle of the passageway 12C is preselected so as to cause light from the bulb 32 to illuminate a work area adjacent the driver element 16A. The lighting means 30 includes a battery 34 and a pair of electrical leads 36A, 36B for selectively connecting the bulb 32 to the battery 34 by a switch mechanism 38. The switch mechanism 38 is attached to the handle lower element 12B by an attaching plate 40, and four fasteners 42, and functions to hold the battery 34 in position. The switch mechanism 38 is shown in FIG. 4 in its actuated position, in which an electrical circuit is completed between the light bulb 32 and the battery 34 though the electrical leads 36A, 36B. The lead 36A is always in physical contact with a first battery terminal comprised by an upper battery face 34A of the disc-shaped battery 34, and the lead 36B has a contact element 36C which is shown in FIG. 4 as being pressed into physical contact with the other battery terminal comprised by a lower battery face 34B of the disc-shaped battery 34 by the chamfered face of an actuator slide 44 formed on a slide switch 46.

The slide switch 46 extends through an aperture 48 formed in the attaching plate 40, so as to permit limited transverse movement of the slide switch 46 between its various operating positions, as will now be explained. The slide switch 46 is a three position switch, that is, it is laterally slidable between three positions, a "neutral" position, as shown in FIG. 7, and "off" position, as shown in FIG. 8, and an "on" position as shown in FIG. 9.

Figure 7:
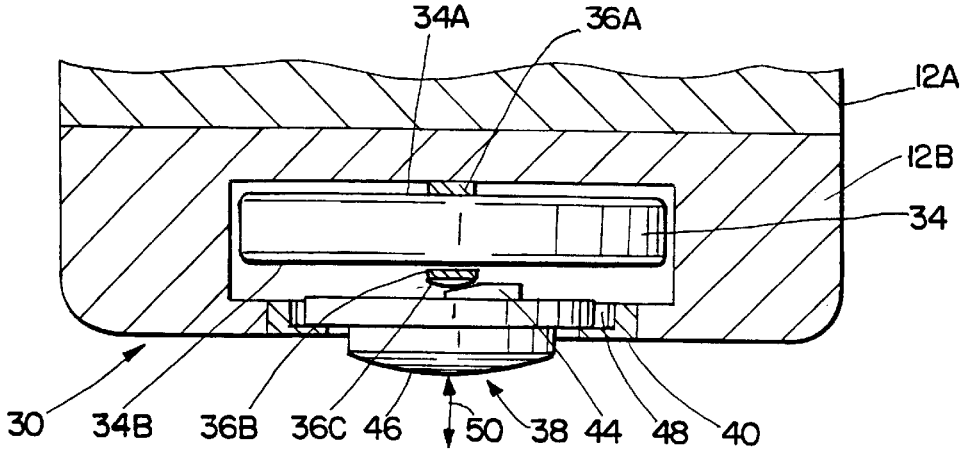
FIG. 7 is a partial front elevational view, in section, taken along lines 7—7 of FIG. 4, and illustrating its electrical lighting system in its "momentarily closed" disposition.

In FIG. 7, the actuator slide 44 is in electrical contact with the lead 36B through the contact element 36C, but the lead 36B is not in electrical contact with the battery terminal 34B because the lead 36B is of the leaf spring type and is biased away from the battery terminal 34B. Therefore, there is no electrical circuit continuity between the battery 34 and the light bulb 32, and the bulb 32 is not illuminated. However, if the slide switch 46 is pressed inwardly manually toward the battery 34, the chamfered surface on the actuator slide 44 will press the electrical contact 36C and so the lead 36B against the battery terminal 34B, causing the electrical circuit to be completed and the bulb 32 to be lit (see FIG. 4). When the inward manual pressure on the slide switch is released, the spring biasing of the lead 36B causes the lead 36B to move away from the battery terminal 36B, thereby opening the electrical circuit as shown in FIG. 7 and extinguishing the lighting of the bulb 32. This manual selective inward and outward movement of the slide switch 46 is illustrated by the bidirectional arrow 50 in FIG. 7.

Figure 8:
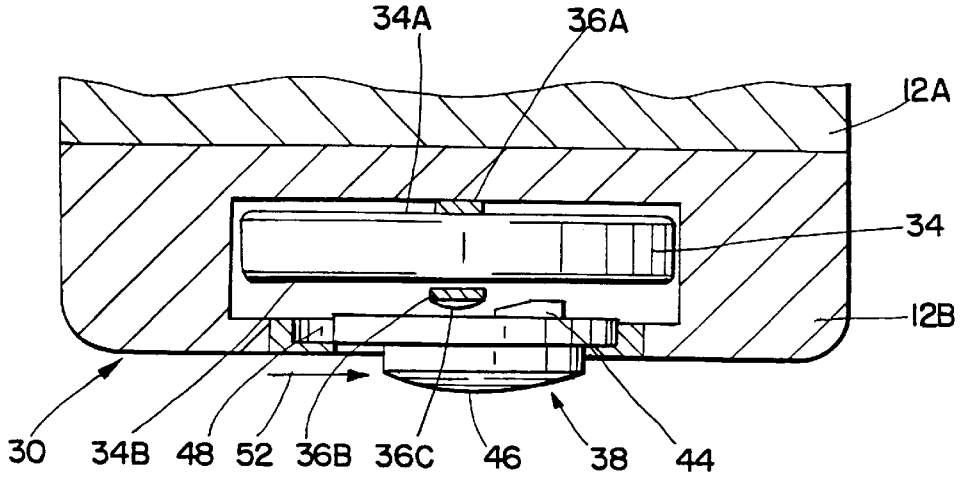
FIG. 8 is a partial front elevational view, in section, of the driver as shown in FIG. 7, and illustrating its electrical lighting system in its "open" disposition.

In FIG. 8, the actuator slide 44 has been moved laterally with respect to its disposition in FIG. 7 so as to offset the actuator slide 44 from the contact element 36C. In this disposition, depression of the slide switch as described with respect to FIG. 7 will not result in the completion of an electrical circuit through the lead 36B to the battery terminal 34B, because no portion of the actuator slide 44 physically contacts the electrical contact 36C or lead 34B, and so the bulb 32 is unlit. This disposition of the slide switch 46 is achieved by lateral movement of the slide switch 46 from the disposition shown in FIG. 7 in the direction as indicated by the arrow 52.

Figure 9:
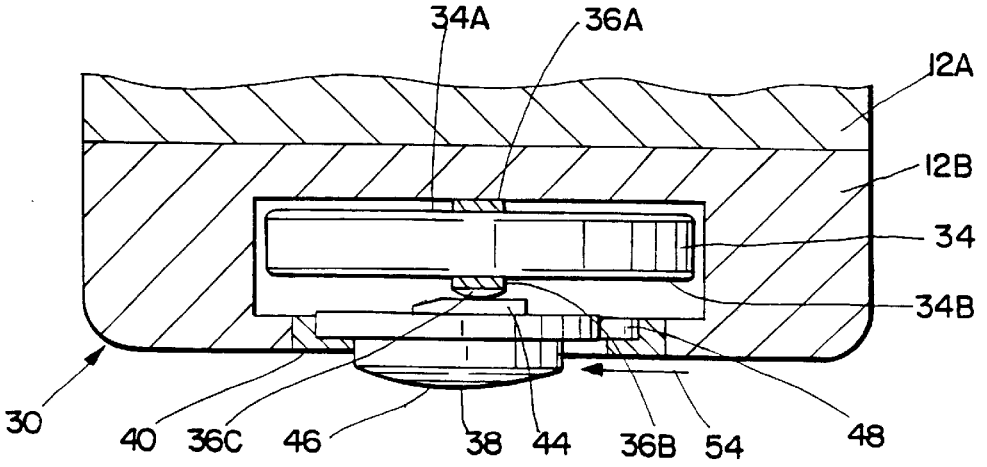
FIG. 9 is a partial front elevational view, in section, of the driver as shown in FIG. 7, and illustrating its electrical lighting system in its "closed" disposition.

In FIG. 9, the actuator slide 44 has been moved laterally with respect to its disposition in FIG. 7 so as to cause the actuator slide 44 to force the contact element 36C toward the battery face 34B, causing the lead 36B to be in continuous contact with the battery terminal 34B even though the slide switch 46 is not depressed. In this disposition, the lateral movement of the slide switch 46 results in the continuous completion of an electrical circuit through the lead 36B to the battery terminal 34B, and the bulb 32 remains lit after the removal of the manual pressure on the slide switch causing its lateral movement to the disposition shown in FIG. 9 from the disposition shown in FIG. 7, and is indicated by the arrow 54 in FIG. 9. When it is desired to extinguish the light 32, the slide switch 46 is manually moved laterally from the disposition shown in FIG. 9 to that shown in either FIG. 8 or FIG. 7.

Figure 10:
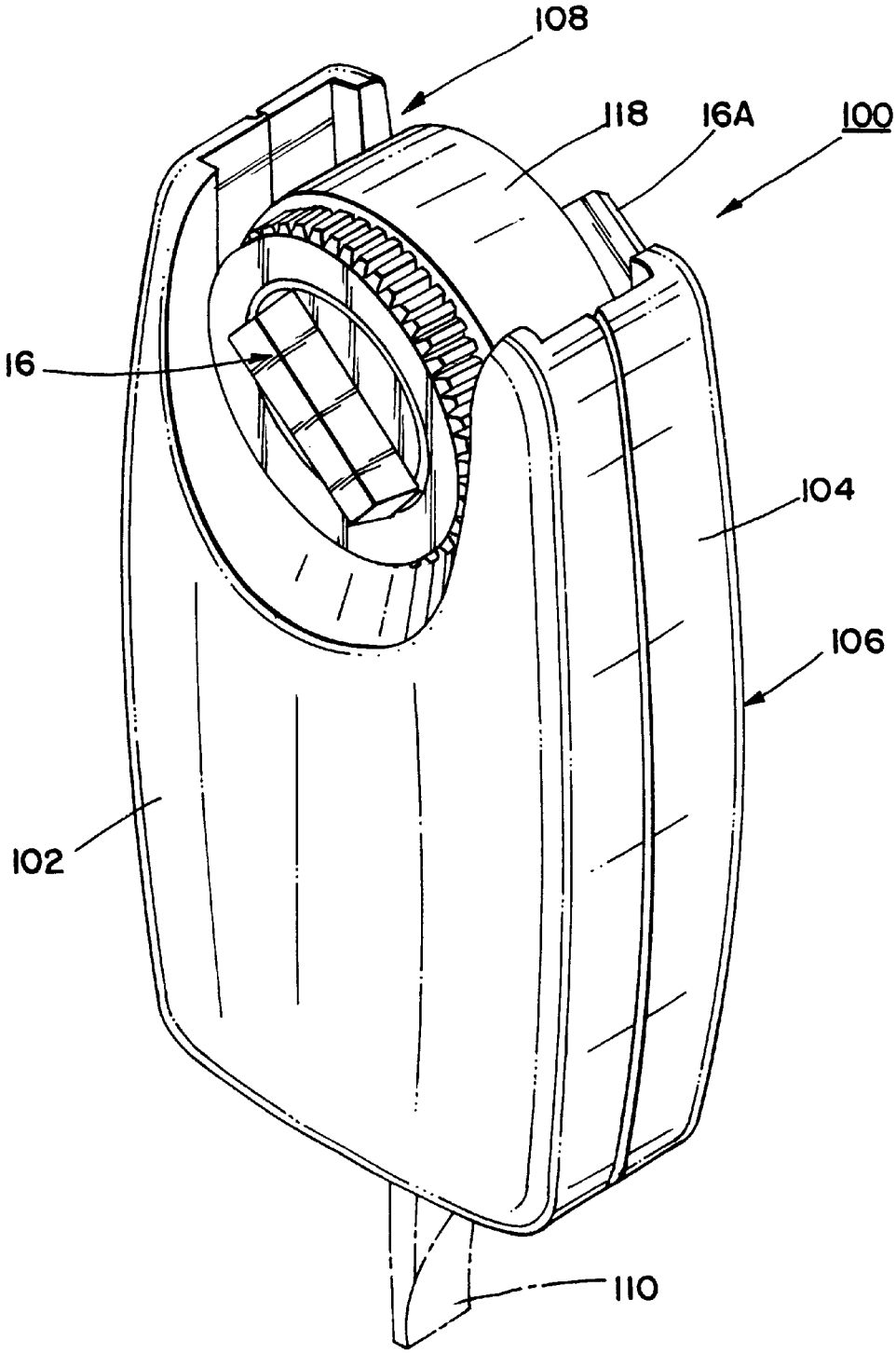
FIG. 10 is a view, in perspective, of a presently preferred alternate embodiment of a compact ratcheting driver according to the present invention shown in its closed disposition, in which the lighting system has been replaced by a drive socket disposed in the driver so as to be remote from its ratcheting head.

Referring now to the presently preferred embodiment of the compact ratcheting driver of the present invention shown in FIGS. 10 through 20, and where like reference numbers refer to like elements with respect to the embodiment of FIGS. 1 through 9, a compact ratcheting driver 100 according to the present invention shown in FIG. 10 in its closed disposition. The driver 100 has an upper body portion 102 and a lower body portion 104 which are attached together by any conventional means so as to form a handle portion 106. The driver includes an extensible ratcheting drive portion 108, which has a ratchet drive mechanism 16, mounted in a ratcheting drive head 118. The drive head has a central web portion 120 and a pair of guide rails 122A,122B, which are coplanar with the web 120 so as to be normal to the longitudinal axis of the driver element 16A. The guide rails 122A,122B extend into a hollow central portion 124 formed between the body portions 102,104 of the handle 106 so as to engage a pair of complementary guide shoulders 124A, 124B,124C,124D (see FIGS. 19,20).

Figure 12:
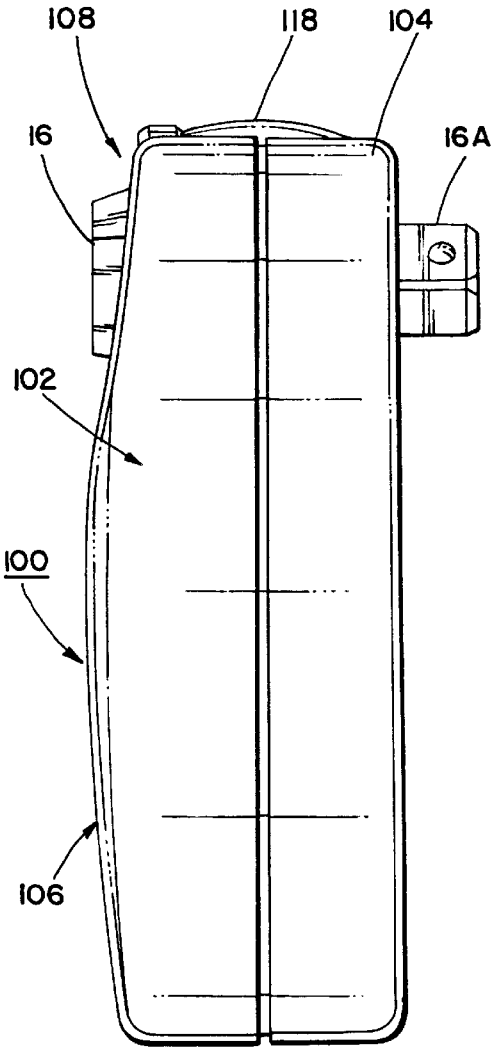
FIG. 12 is a right side elevational view of the compact ratcheting driver of FIG. 10.
Figure 13:
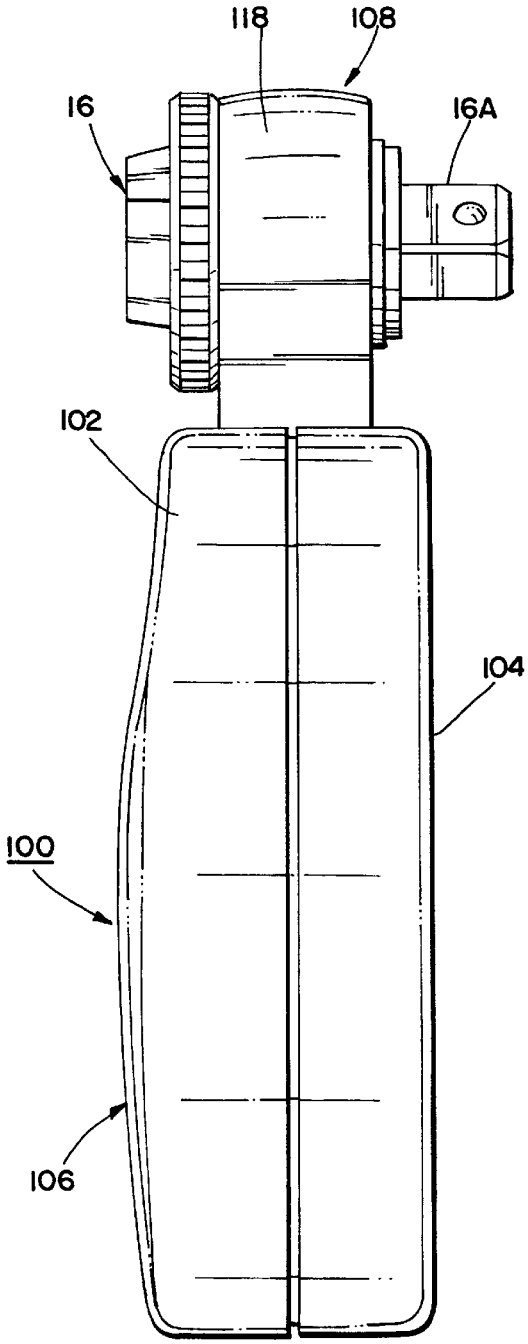
FIG. 13 is a right side elevational view, similar to FIG. 12, but with the ratcheting head in its retracted disposition.
Figure 14:
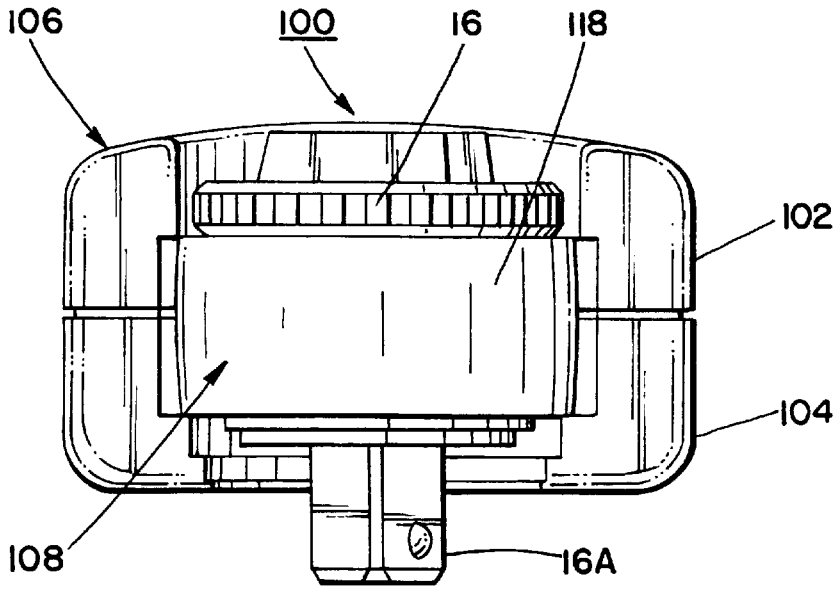
FIG. 14 is a front elevational view of the driver of FIG. 10.
Figure 16:
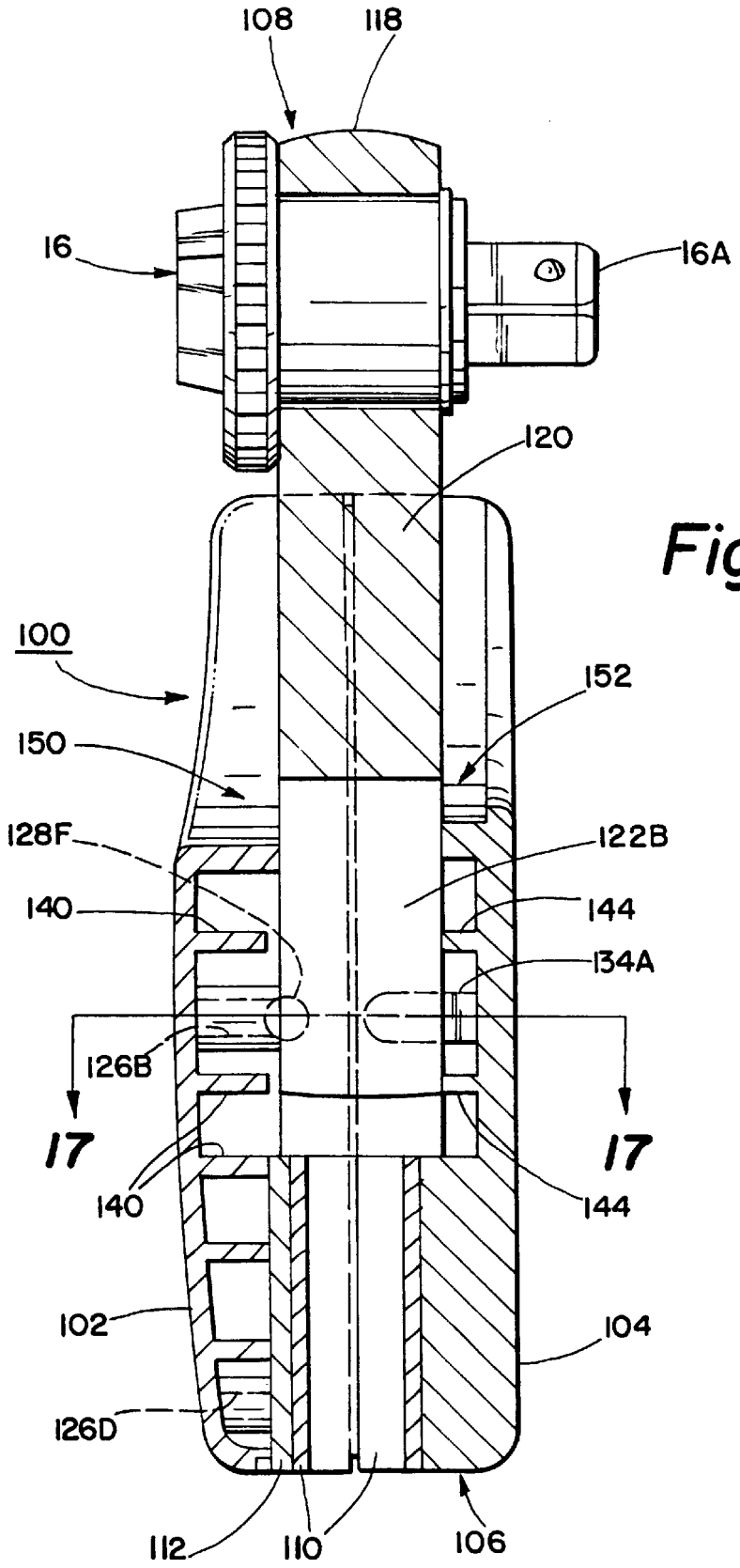
FIG. 16 is a view, in section, of the driver of FIG. 10, taken along lines 16—16 of FIG. 11.

A pair of spring loaded detent ball assemblies 128A,128B are formed, one each, in the rails 122A,122B, respectively. The spring loaded detent ball assemblies 128A,128B are adapted to engage a pair of laterally disposed cylindrical recesses 126A,126B formed in the upper body portion 102 (see FIG. 19) when the extensible drive portion 108 is in its extended disposition as shown in FIG. 16, and to engage a pair of laterally disposed cylindrical recesses 126C,126D formed in the upper body portion 102 (see FIG. 19) when the extensible drive portion 108 is in its retracted disposition as shown in FIG. 12. The spring loaded detent ball assemblies 128A,128B include springs 128C,128D and balls 128E, 128F, respectively, disposed in cylindrical recesses 128G, 128H formed in the rails 122A,122B respectively (see FIG. 18). The guide rails 122A,122B each have a rectangular recess 130A, 130B, extending longitudinally therealong on the lower outside surfaces thereof (see FIG. 18), which terminate in shoulders 132A,132B. The shoulders 132A, 132B engage stops 134A,134B formed in the lower body portion 104 (see FIG. 20).

Figure 11:
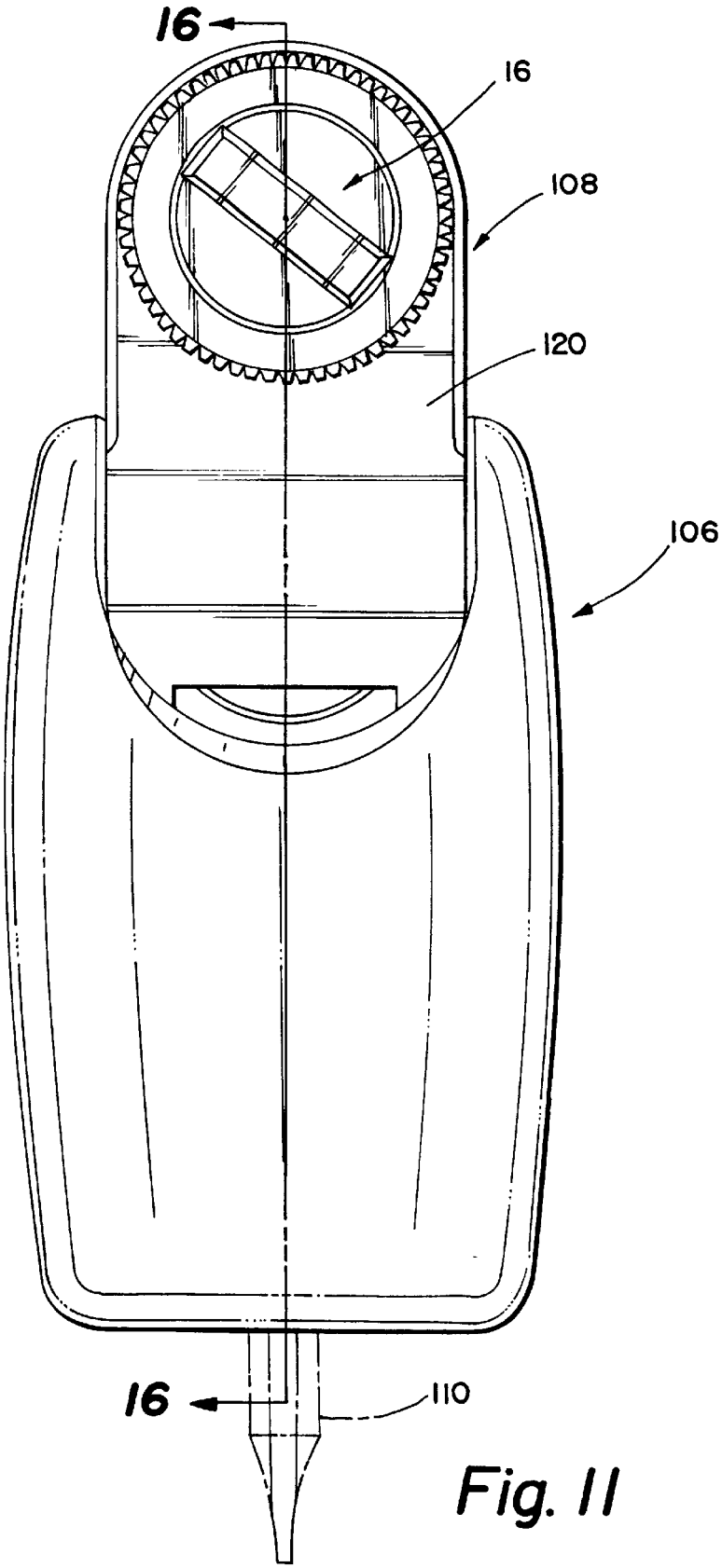
FIG. 11 is a top plan view of the compact ratcheting driver of FIG. 10.
Figure 15:
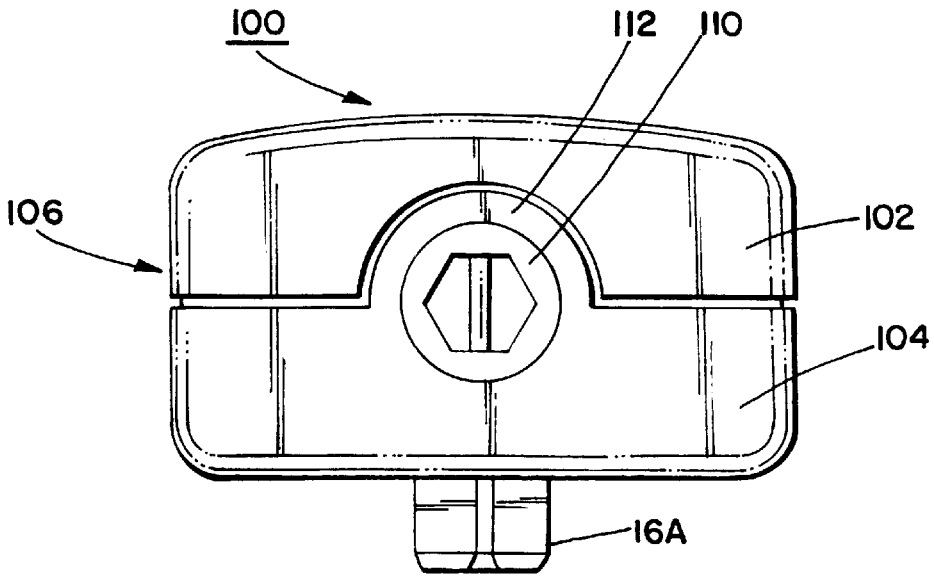
FIG. 15 is a rear elevational view of the driver of FIG. 10, illustrating the disposition of the drive socket, illustrated as a hexagonal socket.

In FIG. 15, the driver 100 is seen to have a drive socket 110, which may be of any conventional cross-section and is illustrated in FIG. 15 as a hexagonal drive socket. The socket 110 is disposed in a socket housing 112 formed in the driver lower body portion 106 (see FIG. 20) so as to be remote from the ratcheting drive head 118. As will be apparent, the drive socket 110 is fixed with respect to the driver 100. In FIGS. 10 and 11, a drive bit 114, shown as a flat blade screwdriver bit for purposes of illustration and not by way of limitation, is shown in dotted lines as being in engagement with the drive socket 110. As will be apparent, manual rotation of the driver 100 about its longitudinal axis, which is coincident with the line 16—16 of FIG. 11, will rotate the drive bit 110 accordingly.

Figure 17:
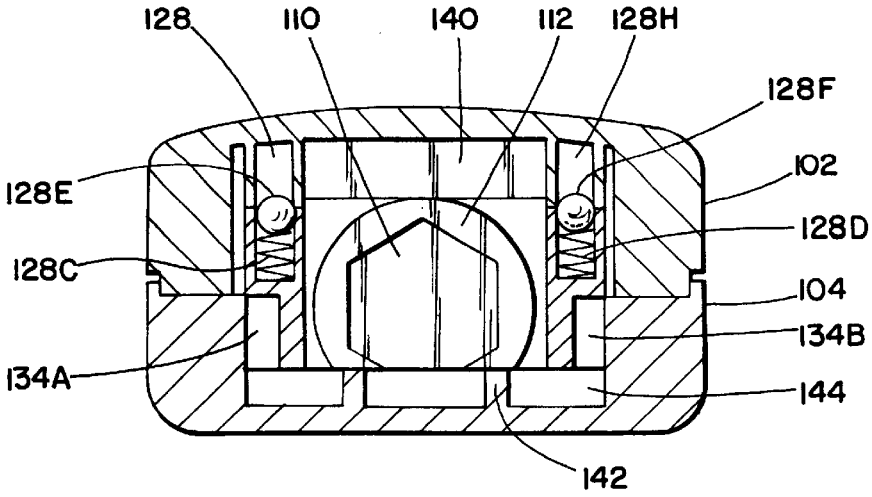
FIG. 17 is a view, in section, of the driver of FIG. 10, taken along lines 17—17 of FIG. 16.
Figure 18:
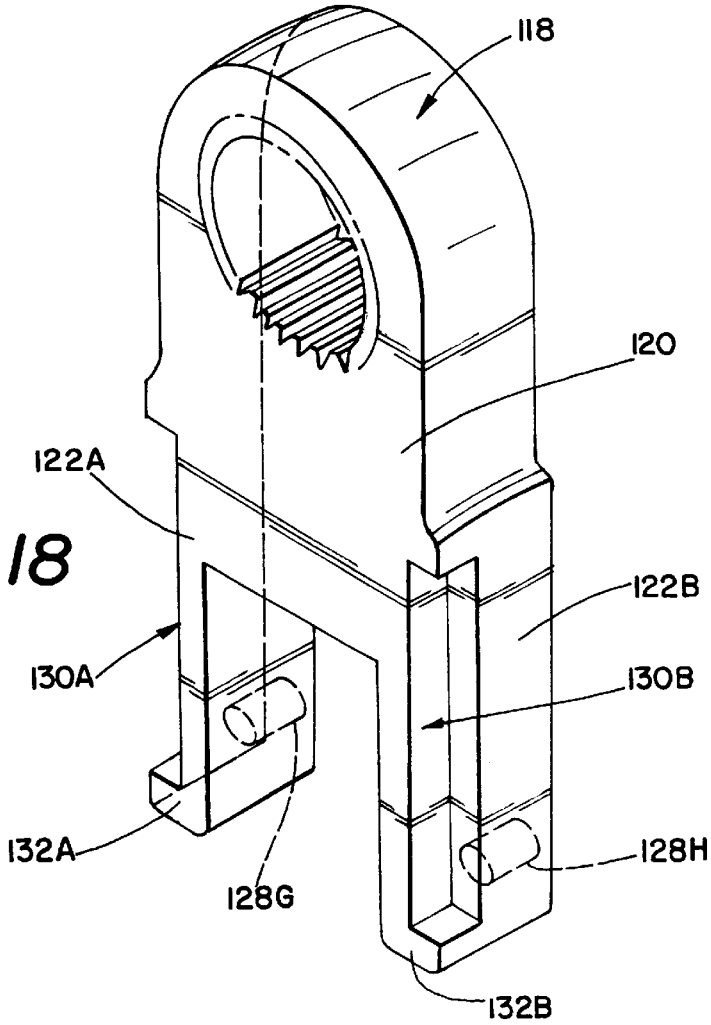
FIG. 18 is a view, in perspective, of the extendible drive portion of the driver of FIG. 10 which carries the ratcheting head, but with the ratcheting head removed.
Figure 19:
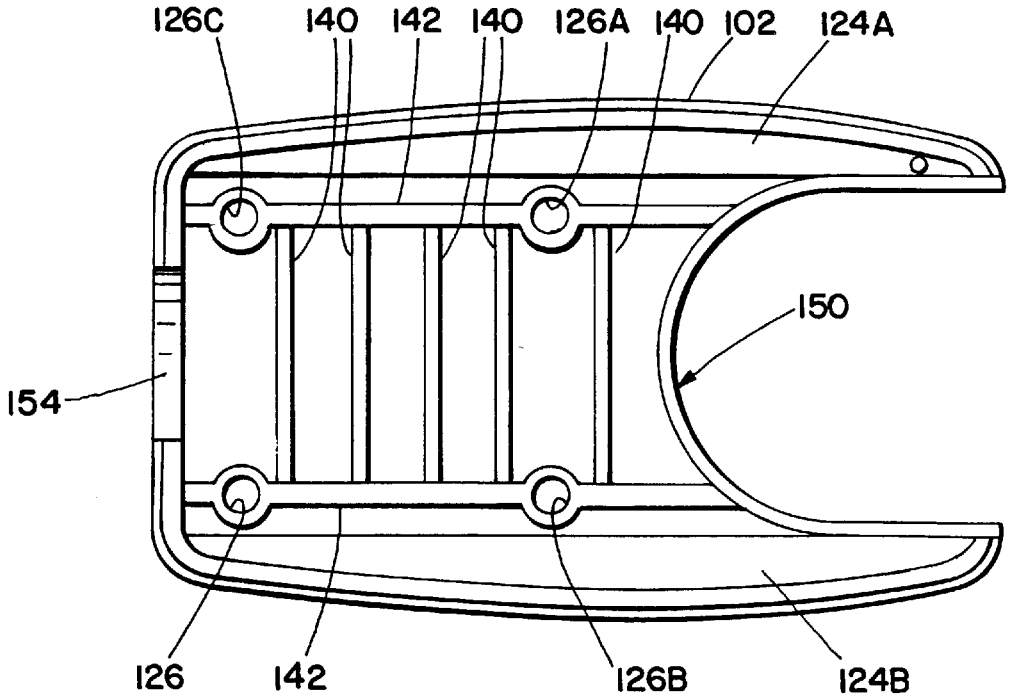
FIG. 19 is a bottom plan view of the upper body portion of the compact ratcheting driver of FIG. 10.
Figure 20:
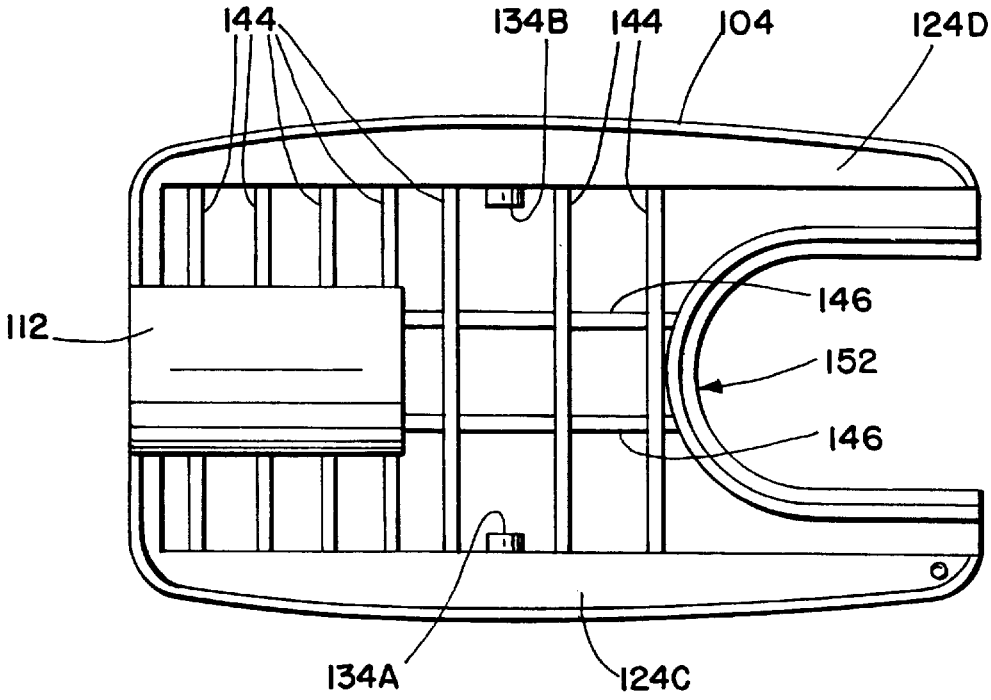
FIG. 20 is a top plan view of the lower body portion of the compact ratcheting driver of FIG. 10.

Referring now to FIGS. 19 and 20, the upper body portion 102 and lower body portion 104 each have a pair of complementary guide shoulders 124A,124B (upper body portion 102) and 124C,124D (lower body portion 104). When the body portions 102,104 are joined together as shown so as to contain the extendible ratcheting drive portion 108, as shown in FIG. 16, the complementary guide shoulders 124A,124B,124C,124D provide vertical surfaces which abut the guide rails 122A,122B (see FIG. 18). The stops 134A,134B engage the guide rail shoulders 132A, 132B to prevent the extendible ratcheting drive portion 108, when in its extended disposition shown in FIGS. 11, 13 and 16, from being withdrawn from the handle 106. When in this extended disposition, as is best seen in FIGS. 16 and 17, the spring loaded detent balls 128A,128B engage their respective recesses 126A,126B so as to hold the ratcheting drive portion 108 in this extended disposition until the biasing of the balls 128A,128B is manually overcome to move the ratcheting drive portion 108 to its retracted disposition, shown in FIGS. 10 and 12. As will be apparent, when in this retracted disposition, the detent balls 128A,128B engage the recesses 126C,126D(see FIG. 20) to maintain the drive portion in this retracted disposition until manually moved to its extended disposition.

The upper body portion 102 and lower body portion 104 are formed, preferably, of a durable moldable or injectable plastic material, such as fiberglass reinforced nylon. As is seen in FIG. 19, the upper body portion 102 has lateral reinforcing ribs 140 extending between a pair of longitudinal reinforcing ribs 142.

As is seen in FIG. 20, the lower body portion 104 has lateral reinforcing ribs 144 extending between a pair of longitudinal reinforcing ribs 146. The upper body portion 102 and lower body portion 104 have complementary semicircular recesses 150,152, respectively, formed at one end thereof, the recess 152 being formed so as to be remote from lower body portion end containing the socket housing 112. As will be apparent, when the upper and lower body portions are mated, the recesses 150,152 permit the ratchet drive head 18 to be retracted into the compact driver as shown in FIG. 10. The upper body portion 102 has a cutout 154 at its end which is remote from the cut out 152, and is complementary in configuration to the socket housing so as to permit the upper and lower body portions 102,104 to abut one another, as is shown in FIG. 15.

As will be apparent from the foregoing, the present invention provides for an extremely compact and strong ratcheting driver in which the selective illumination of the work area adjacent the driver element is readily accomplished by the user by the selective manual actuation of the lighting means as described herein.

The present invention is illustrated for explanatory purposes, and not by way of limitation, as being utilized in conjunction with a square drive ratchet mechanism. However, the invention is equally applicable to other types of drives, including direct drives, and it to be understood to be applicable generally to hand-held tools utilized to rotatably drive fasteners in general.

Although the presently preferred embodiment of the invention has been set forth herein in detail for illustrative purposes, it will be apparent to those skilled in the art that variations and modifications thereof, including the rearrangement of parts, lie within the scope of the present invention, which is not limited to the specific structures of the embodiment shown or described herein, but only by the scope of the following claims.

The invention claimed is:

1. A compact ratcheting driver comprising:

an extensible drive portion including ratcheting means having a drive head with a driver element depending therefrom in a first direction for engaging an element to be driven;

a handle having a hollow central portion for receiving the extensible drive portion; and means for providing for selective manual linear movement of the drive head in a direction normal to the first direction between an extended position in which the driver element is remote from the handle and a retracted position in which the driver element is adjacent the handle, including a pair of parallel guide rails formed on the extensible drive portion so as to be coplanar with and extend into the hollow central portion of the handle to engage a pair of complementary guide shoulders formed within the handle, and including detent means connected between the handle and at least one of the rails for retaining the drive portion in a selected one of its extended and retracted positions until manually overridden, and in which the detent means includes a spring loaded ball utilized for each of the extended and retracted dispositions.

2. A compact driver according to claim 1, and including a drive socket fixed in the handle so as to be remote from the drive head and in longitudinal alignment with the parallel guide rails.

3. A compact driver according to claim 2, and in which the drive socket is disposed intermediate of the guide shoulders.

4. A compact driver according to claim 3, and in which the drive socket is a hexagonal socket.

5. A compact driver according to claim 2, and in which the drive socket is a hexagonal socket.

6. A compact ratcheting driver comprising:

an extensible drive portion including ratcheting means having a drive head with a driver element depending therefrom in a first direction for engaging an element to be driven;

a handle having a hollow central portion with an opening at one end thereof for receiving the extensible drive portion; and means for providing for selective linear movement of the drive head in a direction, normal to the first direction, between an extended position in which the driver element is locked in a disposition so as to be remote from the handle and a retracted position in which the driver is locked in a disposition so as to be adjacent the handle, including (a) a pair of coplanar linear guide rails formed on the extensible drive portion so as to extend away from the drive head into the hollow central portion, and (b) a pair of complementary guide shoulders formed in the handle so as to open into the hollow central portion and abut the guide rails, and including detent means connected between the handle and at least one of the rails for locking the drive portion in a selected one of its extended and retracted positions until manually overridden, and in which the detent means includes a spring loaded ball.

7. A compact driver according to claim 6, and including a docket socket fixed in the handle so as to be remote from the drive head and in longitudinal alignment with the parallel guide rails.

8. A compact driver according to claim 7, and in which the drive socket is disposed intermediate of the guide shoulders.

9. A compact driver according to claim 8, and in which the drive socket is a hexagonal socket.

10. A compact driver according to claim 7, and in which the drive socket is a hexagonal socket.

11. A compact ratcheting driver comprising:

a handle portion;

a ratcheting head portion including ratcheting means connected to a driver element for engaging an element to be driven;

a pair of guide rails formed on the head portion so as to be disposed on opposite sides of and coplanar with and extend into the handle to engage a pair of complementary guide shoulders formed within the handle; and lighting means contained within the handle portion and selectively manually operable for the illumination of a work area in which the driver element is to engage an element to be driven, including a slide switch having an "on" position, an "off" position, and a third position and operable (a) when in its "on" position to provide continuous illumination of the work area in which the driver element is to engage the driven element, (b) when its "off" position to prevent the illumination from the driver of the work area in which the driver element is to engage the driven element, and, (c) when in its third position to permit the manual depression of the slide switch to provide illumination of the work area in which the driver element is to engage the driven element for so long as the slide switch is depressed.

* * * * *